US005863278A

United States Patent [19]

Chen

[11] Patent Number: 5,863,278

[45] Date of Patent: Jan. 26, 1999

[54] BOXING DRILL DEVICE

[76] Inventor: James Chen, No. 35, Tun Hi Rd., Chin Chan Li, Sa Lu, Taichung, Taiwan

[21] Appl. No.: 662,607

[22] Filed: Jun. 13, 1996

[51] Int. Cl.[6] ..... N63B 69/00

[52] U.S. Cl. ..... 482/83; 482/87; 482/90

[58] Field of Search ..... 482/83–90

[56] References Cited

U.S. PATENT DOCUMENTS

| | | | |
|---|---|---|---|
| 2,156,831 | 5/1939 | Andre | 482/83 |
| 4,482,150 | 11/1984 | Levine | 482/90 |
| 4,557,478 | 12/1985 | Levine | 482/90 |
| 4,749,184 | 6/1988 | Tobin | 482/87 |
| 4,973,045 | 11/1990 | Heberer | 482/83 |
| 5,512,029 | 4/1996 | Barnard et al. | 482/124 |
| 5,586,962 | 12/1996 | Hallmark | 482/124 |

*Primary Examiner*—Jerome Donnelly
*Attorney, Agent, or Firm*—Browdy and Neimark

[57] ABSTRACT

A boxing drill device comprises a base having two support rods which are braced by a connection rod and are provided respectively with long segment and a short segment. A support frame is mounted uprightly on the base such that the bottom end of an upright rod of the support frame is fastened between two short segments of the support rods. The upright rod of the support frame is provided at the top thereof with a first suspension rod fastened therewith and a second suspension rod fastened therewith. The first suspension rod is provided with a sand bag fastened thereto while the second suspension rod is provided with a hammer ball fastened thereto. The upright rod of the support frame is braced by two reinforcing rods so as to give the upright rod an added support.

5 Claims, 4 Drawing Sheets

BOXING DRILL DEVICE

FIELD OF THE INVENTION

The present intention relates generally to an exercise device, and more particularly to a boxing drill device.

BACKGROUND OF THE INVENTION

The conventional boxing drill device is generally made up of a base on which an upright rod is erected. The upright rod is provided at the top thereof with a suspension rod fastened horizontally thereto. The suspension rod is provided at one end thereof with a sand bag fastened securely thereto for a boxer to do a fighting drill, a pushing drill, a kicking drill, etc. Such, a conventional boxing drill device as described above is defective in design in that its support frame is vulnerable to overturn when the sand bag is hit excessively hard by the boxer.

SUMMARY OF THE INVENTION

It is therefore the primary objective of the present invention to provide an improved boxing drill device devoid of the shortcoming of the prior art boxing drill device described above.

In keeping with the principle of the present invention, the foregoing objective of the present invention is attained by a boxing drill device, which comprises a base having two support rods which are braced by a connection rod and are provided respectively with a long segment and a short segment. A support frame is mounted uprightly on the base such that the bottom of an upright rod of the support frame is fastened between two short segments of two support rods. The upright rod of the support frame is provided at the top thereof with a first suspension rod and a second suspension rod. The first suspension rod is provided with a sand bag fastened thereto while the second suspension rod is provided with a hammer ball fastened thereto. The upright rod is braced at the lower segment thereof by two reinforcing rods for providing the boxing drill device with an additional support.

The foregoing objective, features, functions and advantages of the present invention will be more readily understood upon a thoughtful deliberation of the following detailed description of a preferred embodiment of the present invention in conjunction with the accompanying drawings.

DETAILED DESCRIPTION OF THE INVENTION

Figure 1:
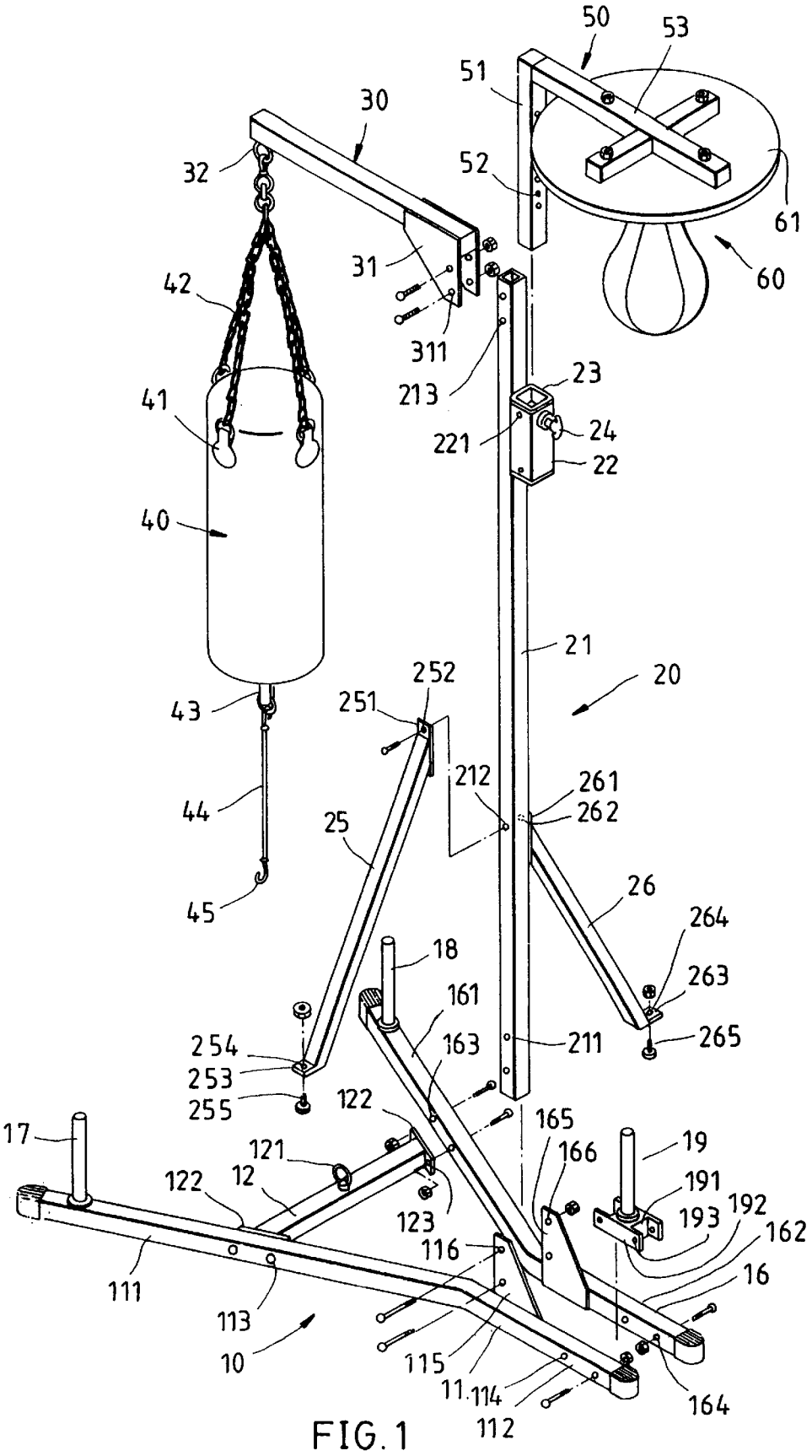
FIG. 1 shows an exploded view of the embodiment of the present invention.
Figure 2:
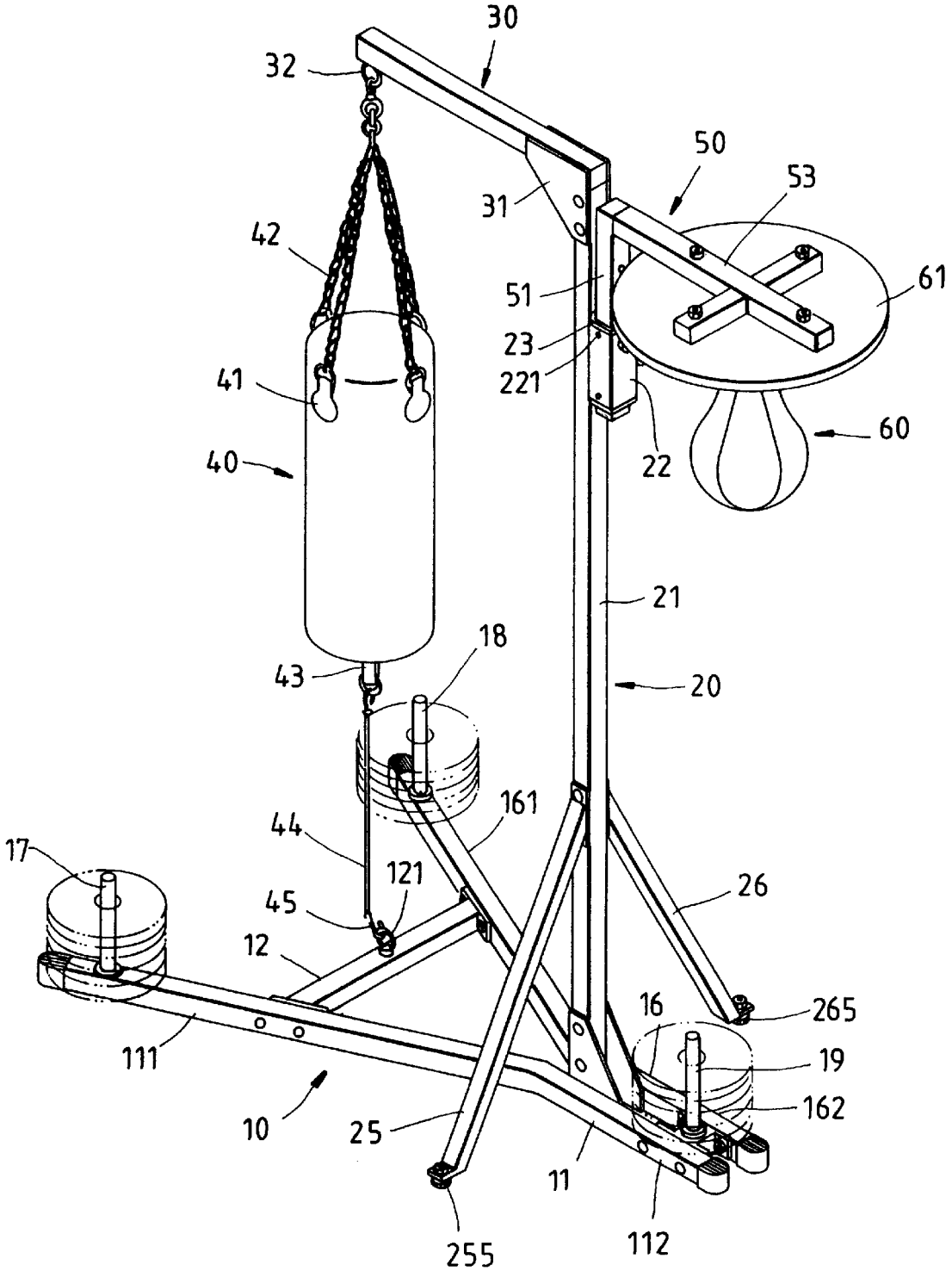
FIG. 2 shows a perspective view of the embodiment in combination according to the present invention.
Figure 3:
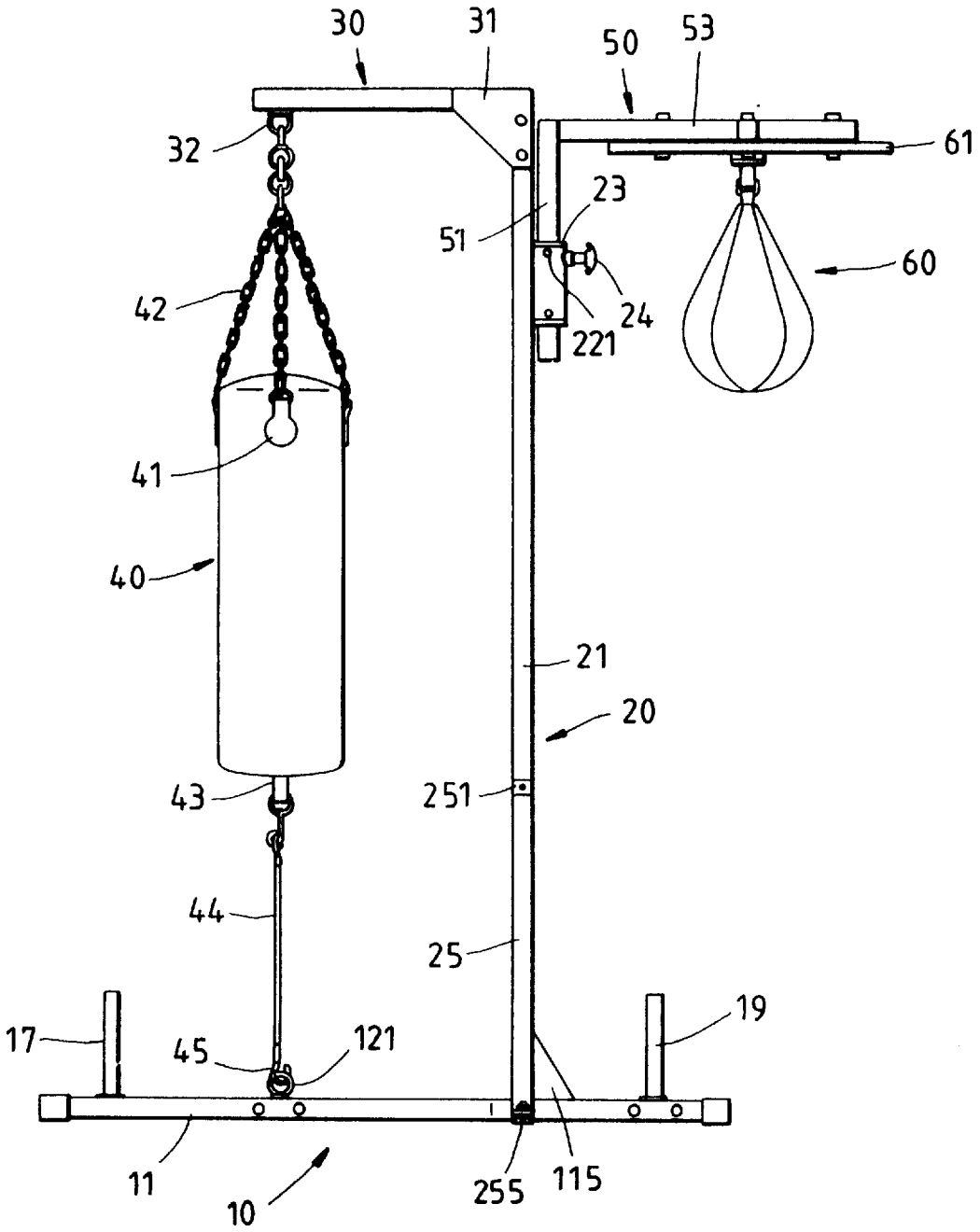
FIG. 3 shows a side plan view of the embodiment in combination according to the present invention.

As shown in FIGS. 1–3, a boxing drill device embodied in the present invention is composed of the component parts, which are described explicitly hereinafter.

A base 10 is composed of two curved support rods 11 and 16, a connection rod 12, and three upright bars 17, 18 and 19. Two support rods 11 and 16 are arranged symmetrically.

The support rods 11 and 16 are also symmetrical in construction in that the support rods 11 is composed of a long segment 111 and a short segment 112, and that the support rod 16 is composed of a long segment 161 and a short segment 162. The long segment 111 of the support rod 11 is provided at the midsegment thereof with two through holes 113. Similarly, the long segment 161 of the support rod 16 is provided at the midsegment thereof with two through holes 163. In the meantime, the short segment 112 of the support rod 11 is provided with two through holes 114 while the short segment 162 of the support rod 16 is provided with two through holes 164.

Two support rods 11 and 16 are provided respectively with fastening lugs 115, 165 which are fastened therewith such that they are located near the junction between the long segment and the short segment, and that they are opposite in location to each other. The fastening lugs 115 and 165 are provided respectively with the fastening holes 116, 166. The long segments 111 and 161 of two support rods 11 and 16 are braced by the connection rod 12, which is provided at the midsegment thereof with a retaining ring 121 fastened therewith. The connection rod 12 is provided respectively at both ends thereof with a fastening piece 122 having two fastening holes 123. The connection rod 12 is fastened at both ends thereof with the support rods 11 and 16 by means of a plurality of fastening bolts engageable with the fastening holes 113 and 163 of the support rods 11 and 16, and the fastening holes 123 of the fastening pieces 122 of the connection rod, 12. The upright bars 17 and 18 are fastened respectively near the free ends of the long segment 111 and, 161 of two support rods 11 and 16 while the upright bar 19 is fastened between and near the free ends of the short segments 112 and 162 of the support rods 11 and 16. The upright bar 19 is fastened at one end thereof with a locating seat 191. The locating seat 191 has two plates 192 opposite in location to each other and having two fastening holes 193 engageable with fastening screws for fastening the upright bar 19 between the short segments 112 and 162 of the support rods 11 and 16.

A support frame 20 comprises an upright rod 21, which is fastened at the bottom end thereof with the base 10. The upright rod 21 is provided at the bottom end thereof with two fastening holes 211, at the lower midsegment thereof with two fastening holes 212, and at the top end thereof with two fastening holes 213. Located under the fastening holes 213 is a locating member 22, which is provided with a plurality of retaining holes 221 engageable with the retaining hooks of a plastic piece 23 which is fitted into the locating member 22. The locating member 22 is provided with a locating knob 24. The upright rod 21 is braced by two reinforcing rods 25 and 26. The reinforcing rods 25 and 26 are provided respectively at both ends thereof with fastening pieces 251, 253, 261, 263, which have fastening holes 252, 254, 262, 264. The reinforcing rods 25 and 26 are fastened respectively at the top,end thereof with the upright rod 21 by means of a fastening bolt engaging the fastening holes 252 of the reinforcing rod 25, the fastening holes 212 of the upright rod 21 and the fastening hole 262 of the reinforcing rod 26. The fastening piece 253 of the reinforcing rod 25 is provided with a fastening hole 254 for fastening an adjustable foot 255 while the fastening piece 263 of the reinforcing rod 26 is provided with a fastening hole 264 for fastening an adjustable foot 265. Both adjustable feet 255 and 265 are intended to support the reinforcing rods 25 and 26 on the floor or ground surface.

A first suspension rod 30 is provided at one end thereof with a fastening member 31 which is fastened therewith and is provided with two fastening holes 311 for fastening the fastening member 31 with the top end of the upright rod 21 by two screws engaging the fastening holes 311 and 213. The first suspension rod 30 is further provided at another end thereof with a retaining hook 32.

A sand bag 40 is intended for use by an exerciser to strike it with the repeated blows with hands or feet. The sand bag 40 is held by the retaining hook 32 of the first suspension rod 30 by means of four chains 42 which are retained respectively at one end thereof by the retaining hook 32 and are engaged respectively at another end thereof with one of four retaining lugs 41 fastened with the upper end of the sand bag 40. The sand bag 40 is provided at the bottom end thereof with a retaining hook 43 for holding one end of a pulling cord 44. The pulling cord 44 has a free end provided with a hooked piece 45 which is fastened thereto and is engaged with the retaining ring 121, as shown in FIG. 2, for confining the inertia swing of the sand bag 40 at such time when the sand bag 40 is impacted with blows.

A second suspension rod 50 has a straight arm 51 and a cruciform arm 53 perpendicular to the straight arm 51. The straight arm 51 is provided at the free end thereof with a plurality of locating holes 52 enabling the straight arm 51 to be fastened adjustably with the locating member 22. The adjustable fastening of the straight arm 51 with the locating member 22 is attained by the locating knob 24 which is engageable with the locating holes 52.

A hammer ball 60 is fastened at one end thereof with a disk 61 which is held securely by the cruciform arm 53 of the second suspension rod 50. The hammer bail 60 is similar in construction to the prior art hammer ball and is intended for use by a boxer to strike it with the fast and repeated blows with hands.

Figure 4:
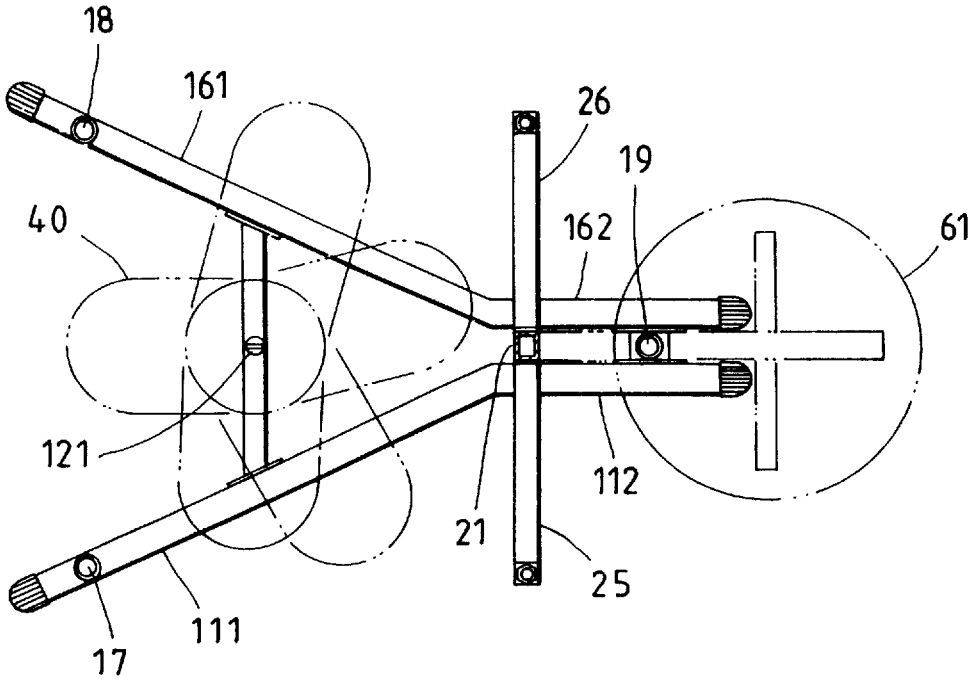
FIG. 4 shows a schematic top view of the embodiment at work according to the present invention.

The base 10 has an A-shaped configuration, which is formed by two support rods 11 and 16 in conjunction with the connection rod 12. For this reason, the support frame 20 of the device of the preset invention is firmly supported on the floor or ground. In addition, the support frame 20 is further supported by two reinforcing rods 25 and 26. As seen in FIG. 4, the upright bars 17–19 are disposed in a generally isosceles triangular pattern with the sand bag 40 fastened above a central area of the triangular pattern, i.e. over the retaining ring 121.

In operation, the sand bag 40 of the present invention is well supported and stabilized, thanks to the upright rod 21 which is held securely by the base 10 of the A-shaped configuration in conjunction with the reinforcing rods 25 and 26. In addition, the base 10 is further stabilized by a plurality of weights which can be held by the upright bars 17,18 and 19. As a result, the boxing drill device of the present invention can not be easily caused to sway irregularly or even overturn at such time when the sand bag 40 is impacted with an excessively violent blow.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A boxing drill device, which comprises:

a base of a predetermined configuration and composed of two support rods and a connection rod with each of said support rods being curved to form a long segment and a short segment, and with said connection rod bracing said two support rods such that said connection rod is located between said two long segments;

said short segments being generally parallel and adjacent one another;

a support frame comprising an upright rod fastened at a bottom end thereof with said two support rods of said base and provided at a top end thereof with a first suspension rod fastened thereto and a second suspension rod fastened thereto, said upright rod further being supported by two reinforcing rods;

a sand bag fastened with a free end of said first suspension rod for use by an exerciser to strike repeated blows on said sand bag with hands or feet; and a hammer ball fastened with a free end of said second suspension rod for use by the exerciser to strike a series of fast blows on said hammer ball with hands;

wherein said long segments of said two support rods are provided respectively at a free end thereof with an upright bar fastened thereto for holding a plurality of weights intended to stabilize said base; and wherein said short segments of said two support rods are provided with an upright bar fastened therebetween for holding a plurality of weights intended to stabilize said base.

2. The boxing drill device as defined in claim 1, wherein said long segment of said support rods is provided with a plurality of fastening holes while said short segment of said support rods is also provided with a plurality of fastening holes for fastening a fastening lug intended for use in fastening said bottom end of said upright rod; and wherein said connection rod is provided with a retaining ring and is fastened at both ends thereof with said long segments of said two support rods.

3. The boxing drill device as defined in claim 1, wherein said upright rod of said support frame is provided with a locating member fastened thereto for holding adjustably said second suspension rod.

4. The boxing drill device as defined in claim 3, wherein said locating member is provided with a locating knob for locating said second suspension rod at a desired level.

5. The boxing drill device as defined in claim 1, wherein (a) the long segment of a first one of the two support rods is equal in length to the long segment of a second one of the two support rods, and the short segment of the first one of the two support rods is equal in length to the short segment of the second one of the two support rods; and wherein the two support rods include a substantially equal angle between their respective long segments and short segments;

whereby the upright bars are disposed in an isosceles triangular pattern with the sand bag fastened above a central area of the triangular pattern; and wherein (b) the upright bars of the long segments and lower ends of the two reinforcing rods are disposed in a generally rectangular pattern.

* * * * *